United States Patent [19]

Rasmussen et al.

[11] 3,977,841

[45] Aug. 31, 1976

[54] RUTHENIUM POWDER METAL ALLOY AND METHOD FOR MAKING SAME

[75] Inventors: Gregory K. Rasmussen, Grand Blanc; John Hrinevich, Jr., Flint, both of Mich.

[73] Assignee: General Motors Corporation, Detroit, Mich.

[22] Filed: Aug. 2, 1974

[21] Appl. No.: 493,873

[52] U.S. Cl. ..... 29/182; 29/182 Z; 75/123 K; 75/170; 75/172 R; 75/176; 75/200; 75/224

[51] Int. Cl.[2] ..... B22F 3/00; C22C 33/00; C22C 19/00; C22C 5/02

[58] Field of Search ..... 29/182, 182.1, 182.2; 75/123 K, 170, 172 R, 176, 200, 214, 224

[56] References Cited

UNITED STATES PATENTS

| | | | |
|---|---|---|---|
| 1,832,307 | 11/1931 | Kingsbury | 75/172 R |
| 2,060,081 | 11/1936 | Jedele | 75/172 R |
| 2,070,451 | 2/1937 | Powell | 75/172 R |
| 2,072,368 | 3/1937 | Jedele | 75/176 |
| 2,072,676 | 3/1937 | Jedele | 75/176 |
| 2,074,474 | 3/1937 | Jedele | 75/176 |
| 2,094,570 | 9/1937 | Estes | 29/182 |
| 2,328,580 | 9/1943 | Pickus | 29/182 |
| 2,467,675 | 4/1949 | Kurtz | 29/182 |
| 2,470,034 | 5/1949 | Hensel | 29/182 |
| 3,301,641 | 1/1967 | Krock | 29/182 |

*Primary Examiner*—Benjamin R. Padgett
*Assistant Examiner*—Donald P. Walsh
*Attorney, Agent, or Firm*—Sidney Carter

[57] ABSTRACT

Ductile ruthenium alloys are provided by mixing, by weight, about 70–80% ruthenium powder with about 20–30% of a pre-alloyed powder consisting essentially of cobalt, nickel, chromium, tungsten and silicon, the powders being of less than 200 mesh size, the mixture being blended with a binder to enable easy handling in pressing a green part using pressures of from about 35,000–50,000 psi followed by sintering in dry hydrogen or inert gas or in a vacuum, sintering temperature and time ranging from about 2150° F to about 2250° F for periods of from about 45 minutes to about 30 minutes, respectively.

5 Claims, No Drawings

RUTHENIUM POWDER METAL ALLOY AND METHOD FOR MAKING SAME

The present invention relates to a novel powder metal ruthenium base alloy having properties of high ductility, high melting point and high resistance to oxidation corrosion and spark erosion.

It is well known that certain physical properties of ruthenium, namely nobility, high melting point, and hardness, make it advantageous for application in the electrical and electronic arts, as for example, as electrical contacts and sparking electrodes. As a practical matter, however, the extreme brittleness of the material makes use thereof impossible. In an attempt to overcome these practical difficulties, the prior art has developed powder metal ruthenium alloys such as covered by the patent to Holtz et al, U.S. Pat. No. 3,278,280 issued Oct. 11, 1966 and the patent to Byran Jones et al, U.S. Pat. No. 3,362,799 issued Jan. 9, 1968, disclosing, respectively, the use of ruthenium, gold, and palladium powders and the use of a ruthenium-rhenium powder mix. In either case, it is readily apparent that the materials are extremely expensive and, as disclosed, that the processing is extremely rigorous and time consuming, with resultant increased costs, in view of the fact that sintering is accomplished at temperatures of about 1500° C (2700° F) over a period of 8 hours.

Similarly, ruthenium metal alloys have been disclosed whereby the individual alloying metals are melted together under conditions to assure complete fusion, a ruthenium-tungsten-nickel alloy being disclosed in the patent to Goldsmith et al, U.S. Pat. No. 1,730,003 issued Oct. 1, 1929. Such an alloy requires the use of very high temperatures in order to melt the individual constituents, the melting point of ruthenium being 2500° C and that of tungsten being 3410° C.

Tungsten-nickel-iron alloys now in use as electrodes in certain spark plugs and igniters will withstand spark erosion and oxidation at temperatures as high as about 1400° F. However, engine developments today require materials which are good at operating temperatures as high as about 2000° F. We have now discovered a novel combination of metallic ingredients and special processing techniques whereby ductile ruthenium base alloy articles may be fabricated having the desirable ruthenium characteristics of oxidation and erosion resistance at such elevated temperatures.

It is an object of our invention to provide a novel ductile ruthenium base powder metal alloy capable of resisting oxidation and spark erosion for extended periods of continuous operation at elevated temperatures.

It is a further object of our invention to provide a method for the production of ductile ruthenium base powder metal alloy articles.

In accordance with our invention there is provided a novel liquid-phase sintered, equi-axed ruthenium base alloy containing, by weight, about 70–80% ruthenium dispersed in about 20–30% of a pre-alloyed metal composition containing, by weight, about 15–19% nickel, about 16–22% chromium, about 0–5% tungsten, about 6–10% silicon, and about 44–63% cobalt. In the alloy provided in accordance with our invention, the ruthenium is present essentially in the form of rounded grains dispersed in and metallurgically bonded at the surface to the liquid phase cobalt base alloy matrix. The melting point of the pre-alloyed metal composition is such as to permit sintering and melting of the composition at temperatures of from about 2150° F to about 2250° F. This sintering range is low enough in temperature so that the less expensive and more available atmosphere furnaces can be utilized. Additionally, the cobalt base liquid phase alloy has excellent ductility properties and is capable of metallurgically interacting with the ruthenium powder at the sintering temperatures to thus give the resultant ruthenium base sintered article good ductility while preserving ruthenium's high temperature resistance to oxidation and spark erosion.

We have found it necessary to use a pre-alloyed powder in combination with the ruthenium in order to keep the sintering temperature as low as possible in order to avoid the necessity for use of special furnace equipment and to minimize the amount of energy required for the sintering operation. The use of individual metal powders would require sintering temperatures substantially higher than that which we are able to use. In addition, the use of individual constituents would greatly complicate the sintering process itself and it is very possible that the alloy matrix of our invention could not be achieved.

From an examination of the micro structure of articles formed in accordance with our invention, we have found that the sintered powder metal alloys have increased porosity as the amount of ruthenium in the alloy increases. By decreasing the amount of ruthenium and increasing the amount of liquid phase pre-alloyed material the porosity is decreased and the ductility of the fired powder alloy is increased. We have also found that the greater the amount of liquid phase alloy used, the greater the shrinkage during the sintering operation.

A preferred sintered powder metal alloy in accordance with out invention contains, by weight, about 75% ruthenium dispersed in a pre-alloyed metal matrix consisting essentially of, by weight, about 12.5% cobalt, about 1.5% tungsten, about 4.5% chromium, about 2% silicon and about 4.5% nickel. The ruthenium powder and the pre-alloyed metal powder are of a size such as to pass through a 200 mesh screen. We have found that the pre-alloyed metal matrix composition of our invention is available commercially from the Wall Colomoy Corporation of Detroit, Michigan, as brazing materials identified as NICROBRAZ 210. While the "210" material contains 0.4% carbon and 0.8% boron in addition to the cobalt, chromium, tungsten, silicon and nickel in accordance with our invention, these additional constituents do not affect the desired properties of either the pre-alloyed powder or the sintered ruthenium base alloy as disclosed herein and such commercially available materials are comprehended within the pre-alloyed metal matrix compositions of our invention.

In the manufacture of articles using the composition of our invention, both the ruthenium powder and the pre-alloyed cobalt base composition, both of a size as to pass through a 200 mesh screen, are thoroughly mixed. The powder mixture may then be blended with a binder which is destroyed during the sintering operation. While other binders well-known in the art are suitable, we have found that a hydroxyethyl cellulose-water mixture in the amount of about 1–2% by weight is suitable. Blending with the binder forms agglomerated particles which we find to have good flow properties for handling convenience. In order to preserve the life of the die cavity during the green pressing operation, the die cavity may be lubricated, e.g., either wiped with a waxy coating material or a wax such as Sterotex may be added during the blending operation. Pressing of the green parts from the unsintered powder mixture is accomplished by using pressures of from about 35,000–50,000 psi — the higher the pressure, the greater the green strength of the parts and the less the porosity of the sintered parts. Sintering is accomplished in a dry non-oxidizing environment such as a hydrogen or inert gas atmosphere or in a vacuum. A low dew point, e.g., −20° F, promotes wetting and flow of the pre-alloyed metal at elevated temperatures. Sintering is accomplished at a temperature of from about 2150° F for a period of about 45 minutes to about 2250° F for a period of about 30 minutes, the higher temperatures being used with those compositions having the higher amounts of ruthenium.

From the foregoing description, it can be readily understood that we have provided a new ruthenium base sintered powder metal alloy composition and a method for forming articles having the desired shape and using such compositions, which composition and articles have high ductility while at the same time retaining the desirable characteristics of ruthenium, high resistance to oxidation and spark erosion at elevated temperatures as high as about 2000°F. While our invention has been described in connection with preferred embodiments, it is to be understood that modifications may be resorted to within the spirit and scope of the invention as defined by the specification and claims which follow.

What is claimed is:

1. A sintered powder metal alloy containing, by weight, about 70 to 80% ruthenium dispersed in a matrix of about 20–30% of a pre-alloyed composition consisting essentially of, by weight, about 44–63% cobalt, about 16–22% chromium, about 0–5% tungsten, about 6–10% silicon and about 15–19% nickel, the surface of said ruthenium powder being soluble in said pre-alloyed composition for ductility and having good oxidation and spark erosion resistance at temperatures as high as about 2000° F., said ruthenium being present essentially in the form of grains dispersed in and metallurgically bonded at the surface to said cobalt base alloy matrix.

2. A sintered metal alloy as set forth in claim 1 consisting essentially of about 75% ruthenium, about 12.5% cobalt, about 1.5% tungsten, about 4.5% chromium, about 2% silicon, and about 4.5% nickel.

3. The method of producing a ductile ruthenium alloy having good oxidation and spark erosion resistance at temperatures as high as about 2000° F. which comprises the steps of compacting a mixture of metal powders of less than 200 mesh size comprising, by weight, about 70–80% ruthenium and about 20–30% of a pre-alloyed composition comprising, by weight, about 44–63% cobalt, about 16–22% chromium, about 0–5% tungsten, about 6–10% silicon and about 15–19% nickel, sintering the compact at a temperature not in excess of about 2250° F. and sufficiently high to melt said pre-alloyed composition to form a matrix in which said ruthenium powder is dispersed and to form a metallurgical bond with said ruthenium at the grain surface and cooling said compact.

4. In the method as set forth in claim 3, the steps of compacting the powders at pressures of from about 35,000 to 50,000 psi, and sintering the resultant green compact in a dry non-oxidizing environment for a period of from about 30 to 45 minutes at a temperature of from about 2150°–2250° F.

5. In the method as set forth in claim 4, said metal powders comprising about 75% ruthenium, about 12.5% cobalt, about 1.5% tungsten, about 4.5% chromium, about 2% silicon and about 4.5% nickel.

* * * * *